US009011996B1

(12) United States Patent
Adolfson

(10) Patent No.: US 9,011,996 B1
(45) Date of Patent: Apr. 21, 2015

(54) ROTATABLE DECORATIVE TREE ASSEMBLY

(71) Applicant: Denise J. Adolfson, Denver, CO (US)

(72) Inventor: Denise J. Adolfson, Denver, CO (US)

( * ) Notice: Subject to any disclaimer, the term of this patent is extended or adjusted under 35 U.S.C. 154(b) by 268 days.

(21) Appl. No.: 13/649,237

(22) Filed: Oct. 11, 2012

(51) Int. Cl.
*A47G 33/06* (2006.01)

(52) U.S. Cl.
CPC ..... *A47G 33/06* (2013.01)

(58) Field of Classification Search
USPC ..... 428/18
See application file for complete search history.

(56) References Cited

U.S. PATENT DOCUMENTS 1,511,588 A * 10/1924 Bleecker ..... 29/527.3
1,665,618 A * 4/1928 Wilson ..... 428/12
3,084,465 A * 4/1963 Hellrich ..... 428/7
3,131,112 A * 4/1964 Abramson ..... 428/8
3,603,780 A * 9/1971 Lu ..... 362/123
3,959,536 A * 5/1976 Chase ..... 428/8
4,343,842 A 8/1982 Chase
6,783,815 B2 8/2004 Flohe
7,128,954 B2 * 10/2006 Tsai ..... 428/17
2004/0212997 A1 10/2004 Ballarini et al.
2007/0092664 A1 4/2007 Chun
2007/0253191 A1 11/2007 Chin et al.

* cited by examiner

*Primary Examiner* — Adam Krupicka

(57) ABSTRACT

A rotatable decorative tree assembly provides a decorative holiday tree that will be rotated by wind. The assembly includes a base and a receiver coupled to the base. A post has a lower end inserted into the receiver wherein the post extends upwardly from the base. The post is rotatable relative to the base. A plurality of collars is coupled to the post positioned in spaced relationship along a length of the post. A plurality of vanes is provided. Each vane is shaped to resemble a tree limb and each vane is couplable to an associated one of the collars.

9 Claims, 4 Drawing Sheets

ROTATABLE DECORATIVE TREE ASSEMBLY

BACKGROUND OF THE DISCLOSURE

Field of the Disclosure

The disclosure relates to decorative tree devices and more particularly pertains to a new decorative tree device for providing a decorative holiday tree that will be rotated by wind.

SUMMARY OF THE DISCLOSURE

An embodiment of the disclosure meets the needs presented above by generally comprising a base and a receiver coupled to the base. A post has a lower end inserted into the receiver wherein the post extends upwardly from the base. The post is rotatable relative to the base. A plurality of collars is coupled to the post positioned in spaced relationship along a length of the post. A plurality of vanes is provided. Each vane is shaped to resemble a tree limb and each vane is couplable to an associated one of the collars.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
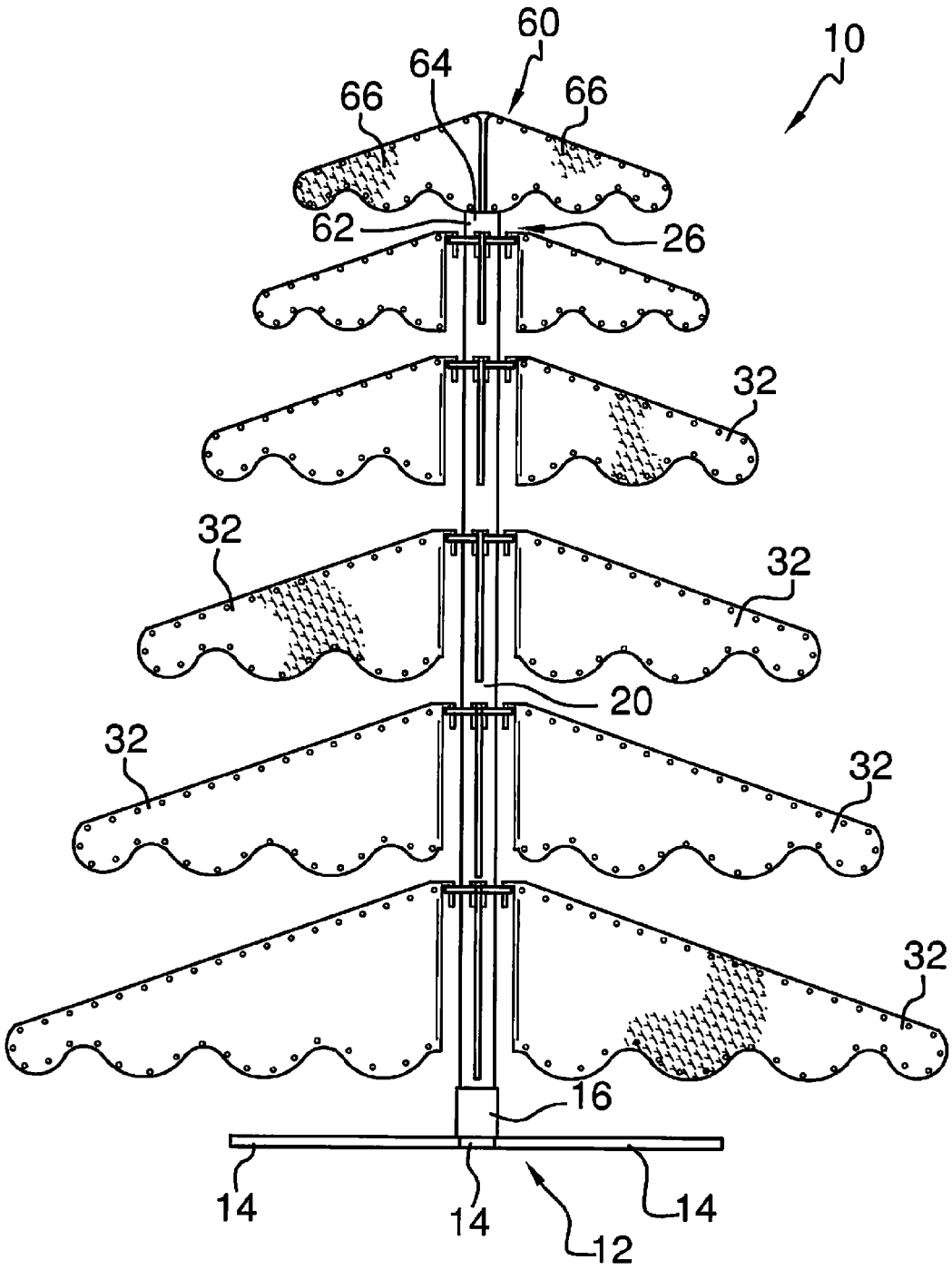
FIG. 1 is a front view of a rotatable decorative tree assembly according to an embodiment of the disclosure.
Figure 2:
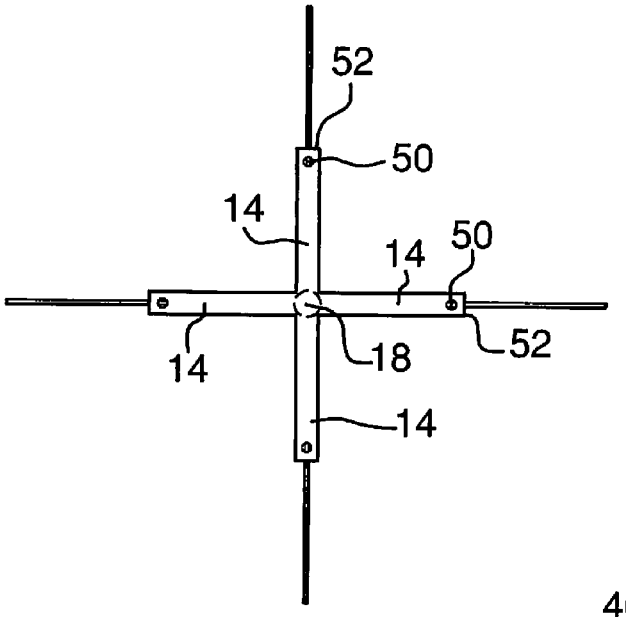
FIG. 2 is a top view of an embodiment of the disclosure.
Figure 4:
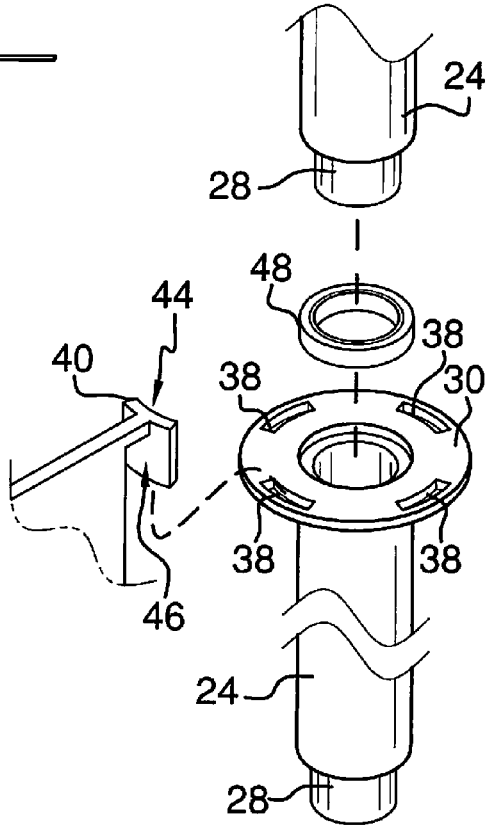
FIG. 4 is a top front side exploded perspective view of an embodiment of the disclosure.
Figure 3:
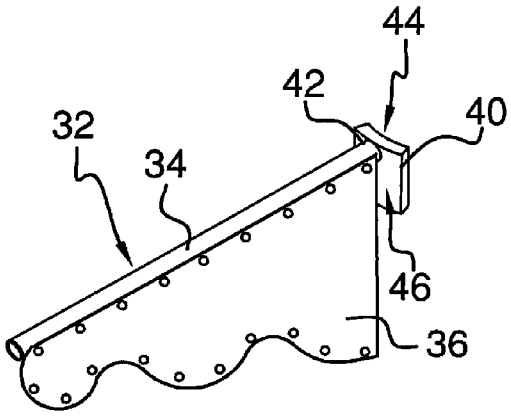
FIG. 3 is a top front side perspective view of an embodiment of the disclosure.
Figure 5:
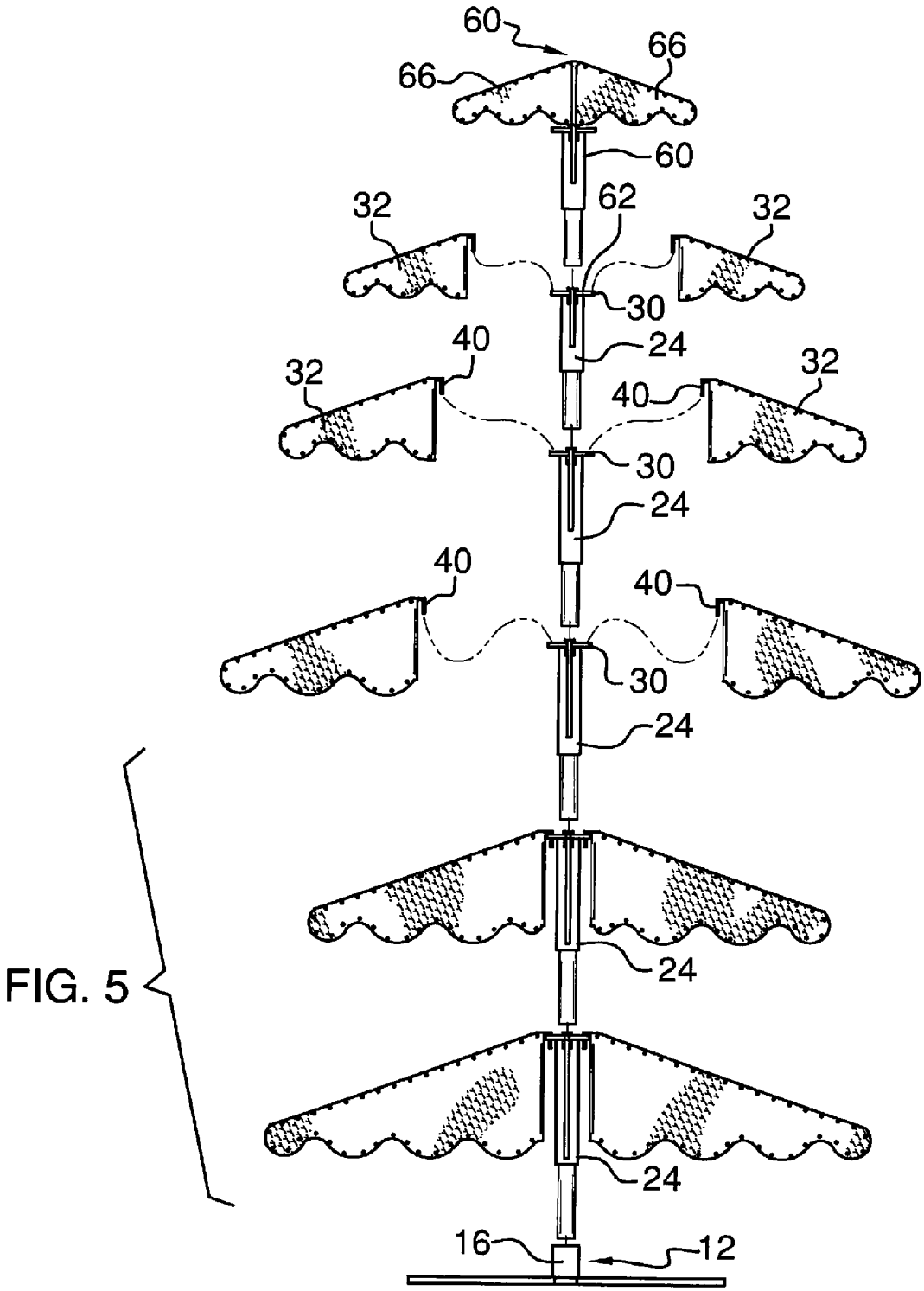
FIG. 5 is a partially exploded front view of an embodiment of the disclosure.
Figure 6:
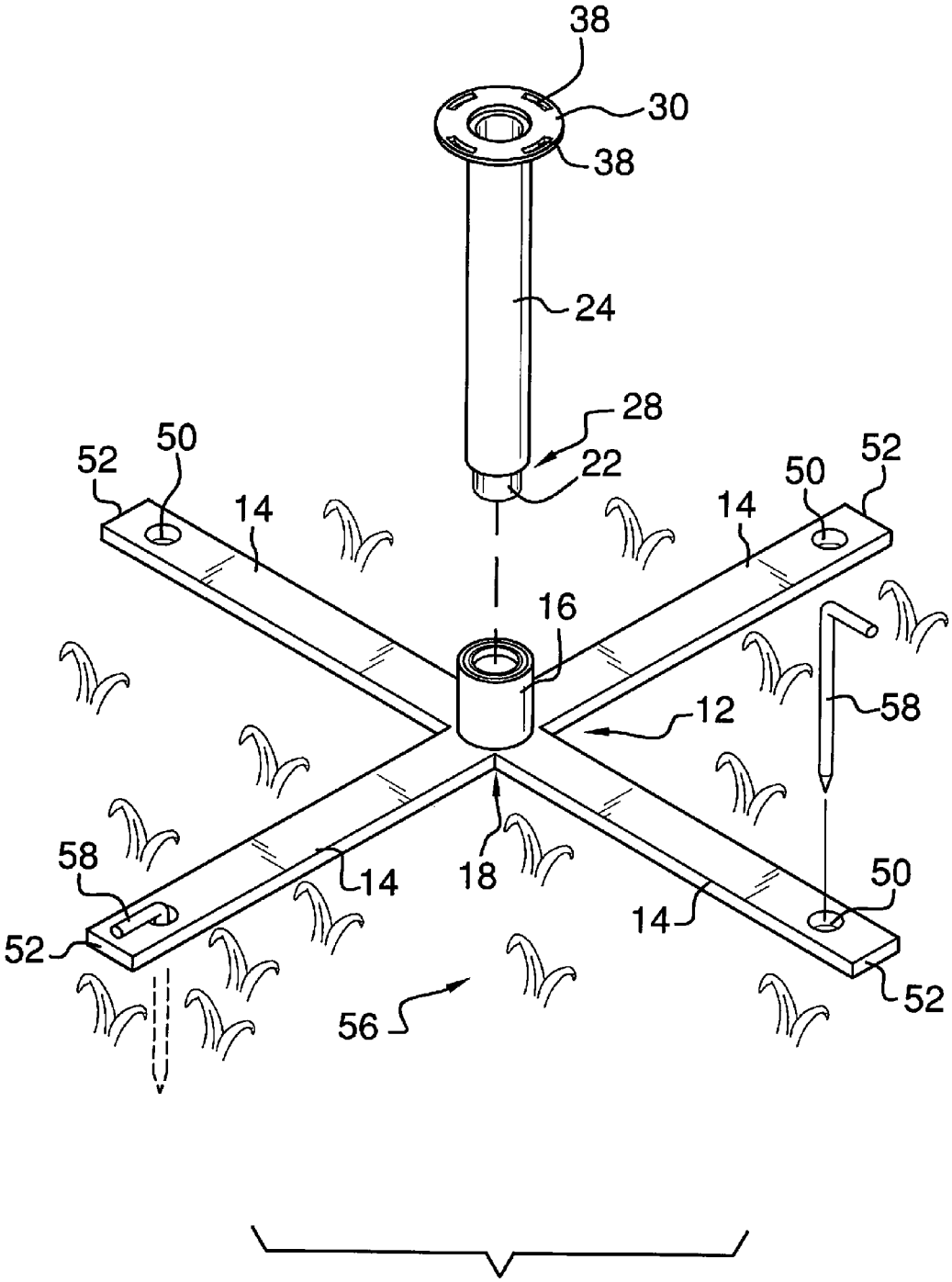
FIG. 6 is a partially exploded top front side perspective view of an embodiment of the disclosure.

With reference now to the drawings, and in particular to FIGS. 1 through 6 thereof, a new decorative tree device embodying the principles and concepts of an embodiment of the disclosure and generally designated by the reference numeral 10 will be described.

As best illustrated in FIGS. 1 through 6, the rotatable decorative tree assembly 10 generally comprises a base 12 having a plurality of outwardly extending legs 14. A plurality of apertures 50 may extend through the base 12. Each aperture 50 may be positioned adjacent a distal end 52 of an associated one of the legs 14 relative to a center of the base 12 wherein the base 12 is configured for being secured to a ground surface 56 by a plurality of stakes 58. A receiver 16 is coupled to the base 12 at a junction 18 of the legs 14. A post 20 has a lower end 22 inserted into the receiver 16 wherein the post 20 extends upwardly from the base 12 and the base 12 supports the post 20 in an upright position. The post 20 is rotatable relative to the base 12. The post 20 may have a plurality of segments 24. Each segment 24 has an open upper end 26 shaped to receive a lower end 28 of another of the segments 24. Each segment 24 is rotatable relative to each other segment 24. A plurality of bushings 48 may be provided. Each bushing 48 is positioned between adjacent segments 24 of the post 20.

A plurality of collars 30 is coupled to the post 20. The collars 30 are positioned in spaced relationship along a length of the post 20. Each collar 30 is substantially a disk. A plurality of slots 38 is radially arranged around each collar 30. Each collar 30 is coupled to an associated one of the segments 24 adjacent the open upper end 26 of the associated segment 24. A plurality of vanes 32 is provided. Each vane 32 is shaped to resemble a tree limb. Each vane 32 is couplable to an associated one of the collars 30. Each vane 32 may have a shaft 34 and a panel 36 coupled to and extending from the shaft 34. A plurality of connectors 40 is utilized. Each connector 40 is coupled to a proximal end 42 of an associated one of the vanes 32 relative to the post 20. Each connector 40 is insertable into a selectable one of the slots 38 wherein the vane 32 is coupled to the collar 30. Each connector 40 may have a curved inner face 44 and a curved outer face 46. Each slot 38 may be shaped complimentary to the connector 40.

A top piece 60 is rotatably coupled to a top end 62 of the post 20 by insertion of the top piece 60 into the open upper end 26 at the top end 62 of the post 20. The top piece 60 has a bottom section 64 and a plurality of panels 66 radially extending from a central axis of the top piece 60. Each panel 66 is shaped to resemble a limb of a tree.

In use, the post 20 is assembled on the base 12 by stacking the segments 24 on the receiver 16. Each vane 32 is coupled to the post 20 by insertion of the connector 40 through an associated slot 38 in a selected collar 30. The top piece 60 is placed on the top end 62 of the post 20. The assembly 10 may be positioned as desired such that wind will engage the vanes 32 and panels 66 to spin the segments 24 of the post 20.

The vanes 32 may be provided in sets having equivalent size which may be attached to a single collar 30. The sets may be unique in size to provide a symmetrical tree shape tapering approaching the top end 62 of the post 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A rotatable decorative tree assembly comprising:

a base;

a receiver coupled to said base;

a post having a lower end inserted into said receiver wherein said post extends upwardly from said base, said post being rotatable relative to said base, said post having a plurality of segments, each said segment having an open upper end shaped to receive a lower end of another of said segments, each segment being rotatable relative to each other segment;

a plurality of bushings, each bushing being positioned between adjacent segments of said post;

a plurality of collars coupled to said post, said collars being positioned in spaced relationship along a length of said post, each said collar being coupled to an associated one of said segments adjacent said open upper end of said associated segment; and a plurality of vanes, each vane being shaped to resemble a tree limb, each said vane being couplable to an associated one of said collars.

2. The assembly of claim 1, further comprising each vane having a shaft and a panel coupled to and extending from said shaft.

3. The assembly of claim 1, further comprising:

a plurality of slots radially arranged around each said collar; and a plurality of connectors, each connector being coupled to a proximal end of an associated one of said vanes relative to said post, each said connector being insertable into a selectable one of said slots wherein said vane is coupled to said collar.

4. The assembly of claim 3, further comprising each said connector having curved inner and outer faces.

5. The assembly of claim 1, further comprising said base having a plurality of outwardly extending legs.

6. The assembly of claim 1, further comprising a plurality of apertures extending through said base wherein said base is configured for being secured to a ground surface by a plurality of stakes.

7. The assembly of claim 1, further comprising a top piece rotatably coupled to a top end of said post, said top piece having a bottom section and a plurality of panels radially extending from a central axis of said top piece.

8. The assembly of claim 7, further comprising each panel being shaped to resemble a limb of a tree.

9. A rotatable decorative tree assembly comprising:

a base, said base having a plurality of outwardly extending legs;

a receiver coupled to said base;

a post having a lower end inserted into said receiver wherein said post extends upwardly from said base, said post being rotatable relative to said base, said post having a plurality of segments, each said segment having an open upper end shaped to receive a lower end of another of said segments, each segment being rotatable relative to each other segment;

a plurality of collars coupled to said post, said collars being positioned in spaced relationship along a length of said post, each said collar being coupled to an associated one of said segments adjacent said open upper end of said associated segment;

a plurality of vanes, each vane being shaped to resemble a tree limb, each said vane being couplable to an associated one of said collars, each vane having a shaft and a panel coupled to and extending from said shaft;

a plurality of slots radially arranged around each said collar;

a plurality of connectors, each connector being coupled to a proximal end of an associated one of said vanes relative to said post, each said connector being insertable into a selectable one of said slots wherein said vane is coupled to said collar, each said connector having curved inner and outer faces;

a plurality of bushings, each bushing being positioned between adjacent segments of said post;

a plurality of apertures extending through said base wherein said base is configured for being secured to a ground surface by a plurality of stakes; and a top piece rotatably coupled to a top end of said post, said top piece having a bottom section and a plurality of panels radially extending from a central axis of said top piece, each panel being shaped to resemble a limb of a tree.

* * * * *